United States Patent [19]

Dickson et al.

[11] 3,993,830

[45] *Nov. 23, 1976

[54] SOIL-RELEASE FINISH

[75] Inventors: Robert E. Dickson, Belle Mead, N.J.; Stanley M. Barkin, Pittsburgh, Pa.

[73] Assignee: Colgate-Palmolive Company, New York, N.Y.

[ * ] Notice: The portion of the term of this patent subsequent to Mar. 19, 1992, has been disclaimed.

[22] Filed: Oct. 23, 1973

[21] Appl. No.: 408,480

Related U.S. Application Data

[63] Continuation-in-part of Ser. No. 248,658, April 28, 1972, Pat. No. 3,798,169.

[52] U.S. Cl. ..... 428/290; 252/8.6; 260/29.6 M; 428/393; 428/394; 428/395

[51] Int. Cl.[2] ..... D06M 15/14

[58] Field of Search ..... 252/8.6, DIG. 2; 117/139.5 A; 260/29.6 M; 428/393, 394, 395, 290

[56] References Cited

UNITED STATES PATENTS

| | | | |
|---|---|---|---|
| 2,999,774 | 9/1961 | Schappel | 117/139.5 CF |
| 3,377,249 | 4/1968 | Marco | 117/139.5 CF |
| 3,563,904 | 2/1971 | Schmadel et al. | 252/152 |
| 3,574,620 | 4/1971 | Tesoro | 117/139.5 CF |
| 3,658,570 | 4/1972 | Crooks et al. | 117/139.5 R |
| 3,671,292 | 6/1972 | Hirschfield et al. | 117/139.5 CF |
| 3,782,898 | 1/1974 | Mandell | 8/137 |
| 3,798,169 | 3/1974 | Dickson et al. | 252/89 |
| 3,816,308 | 6/1974 | Le Blanc | 252/8.5 A |

*Primary Examiner*—Donald E. Czaja
*Assistant Examiner*—Earl A. Nielsen
*Attorney, Agent, or Firm*—Steven J. Baron; Norman Blumenkopf; Herbert S. Sylvester

[57] ABSTRACT

A composition for applying a non-permanent soil-release finish to fabrics from dilute solution comprising a polycarboxylate polymer having an acid equivalent weight of from about 110 to 175, and a water-soluble salt of a polyvalent metal. A preferred polymer is derived from an ethylenically unsaturated monocarboxylic acid and an alkyl acrylate. The composition is particularly useful for applying a soil-release finish in the rinse cycle of a home laundry process.

19 Claims, No Drawings

SOIL-RELEASE FINISH

This application is a continuation-in-part of our copending application Ser. No. 248,658, filed on Apr. 28, 1972, now U.S. Pat. No. 3,798,169, issued Mar. 19, 1974.

BACKGROUND OF THE INVENTION

This invention relates to a composition for treating a textile substrate to impart a soil-release characteristic thereto which can, if desired, be conveniently used in the rinse cycle of a home laundry procedure.

The genesis of synthetically produced textile fibers had brought about a tremendous effort in the textile industry along numerous avenues. There has been much research effort directed to the improvement of these synthetic fibers per se, and improved blends of synthetically produced fibers with natural fibers, i.e., cellulosic fibers or keratinous fibers. Results of this research have been successful and the direction of research has been diverted from the synthetic polymer per se and/or blends of said polymers with other naturally occurring fibers. Recently, fiber research has been directed towards improving physical characteristics of fabric produced from synthetic fibers and/or blends of these synthetic fibers with naturally occurring fibers, and, more specifically, to the physical characteristics and/or endurance properties of garments produced from synthetic fabrics and/or fabric produced from blends of synthetic fibers and naturally occurring fibers.

Much research has been directed to the attainment of a garment having improved soil-release properties. Many of the synthetically produced fibers that are presently being incorporated in blends with naturally occurring fibers have a propensity to accept and retain oily grime and dirt. Accordingly, when the garment is being worn the soil and/or oily materials accumulate on the garment and settle in the fabric. Once the garment becomes soiled, it is then subjected to a cleaning process for removal of the dirt and/or oily deposits, and only a dry cleaning process will successfully clean the garment.

The cleaning process normally employed, however, is washing in a conventional home washing machine by the housewife. During a wash cycle, it is virtually impossible to remove the soil and/or oily stains from the garment and, secondly, assuming that the undesirable materials are removed from the garment or a fairly clean garment is being washed, soil remaining in the wash water is redeposited onto the garment prior to the end of the wash cycle. Hence, when the garment is removed from the washing machine and subsequently dried, it has not been properly cleaned. Such a condition, heretofore unavoidable, is quite disadvantageous in that the garment after being worn never again assumes a truly clean appearance, but instead tends to gray and/or yellow due to the soil and/or oily materials deposited and remaining thereon. Further use and washing of the garment increases the intensity of the graying to the point that ultimately the garment is unacceptable for further wear due to its discoloration. The process of the present invention solves the soiling problem as hereinafter described.

The problem heretofore confronted with fabrics having synthetic fibers incorporated therein, or made entirely of synthetic fibers, has been that the synthetic fibers, as well as being hydrophobic, are oleophilic.

Therefore, while the oleophilic characteristics of the fiber permit oil and grime to be readily embedded therein, the hydrophobic properties of the fiber prevent water from entering the fiber to remove contaminants therefrom.

Attempts have been made to reduce the oleophilic characteristics of these synthetic fibers by coating the fibers with a coating that is oleophobic, i.e., will hinder the attachment of soil or oily materials to the fiber. Many polymer systems have been proposed which are capable of forming a film around the fibers that constitute the textile material, particularly acid emulsion polymers prepared from organic acids having reactive points of unsaturation. These treating polymers are known as soil-release agents.

The term "soil-release" in accordance with the present invention refers to the ability of the fabric to be washed or otherwise treated to remove soil and/or oily materials that have come into contact with the fabric. The present invention does not wholly prevent the attachment of soil or oily materials to the fabric, but hinders such attachment and renders the heretofore uncleanable fabric now susceptible to a successful cleaning operation. While the theory of operation is still somewhat of a mystery, soiled, treated fabrics when immersed in detergent-containing wash water experience an agglomeration of oil at the surface. This water is basic in nature, and it has been determined that soil-release is best realized in wash water that is basic in nature. These globules of oil are then removed from the fabric and rise to the surface of the wash water. This phenomenon takes place in the home washer during continued agitation, but the same effect has been observed even under static conditions. In other words, a strip of polyester/cotton fabric treated with a dilute aqueous solution of the composition of the present invention and soiled with crude oil, when simply immersed in a detergent solution will lose the oil even without agitation.

Concentrated solutions of soil-release polymers have been padded onto fabrics to impart a permanent soil-release finish to the fabrics. As the amount of soil-release polymer on the fabric is increased, the ability of the fabric to release soil is increased. However, fabrics with this permanent soil-release finish possess many disadvantages. As the amount of soil-release polymer on the fabric is increased, the fabric has a tendency to become stiffer and lose the desirable hand characteristic of the fabric. Thus, the upper limit on the amount of soil-release polymer is determined by economics and the resulting adverse effect on the fabric, i.e., the hand of the fabric. Fabrics with a relatively heavy application of soil-release polymer do not have the same desirable appearance and hand as the fabrics without the soil-release polymer. Furthermore, practically speaking, there is a set range of soil-release agent that can be applied, dictated by commercial success.

Some soil-release polymers are effective fabric treating agents even at very low levels on the fabric, at which levels the appearance and hand of the fabric are not adversely affected. Thus, an ideal method of treating a synthetic fiber-containing fabric would be to reapply a very small amount of soil-release polymer each time the fabric is washed, such as in the rinse cycle of a home laundry procedure.

Certain polycarboxylate polymers are very effective soil-release agents at low levels on the fabric. However, they cannot be applied to fabrics from dilute aqueous solutions because the polymers are so soluble in water that they will not deposit onto the fabric from dilute solutions.

SUMMARY OF THE INVENTION

It has now been discovered that a very effective non-permanent soil-release finish can be applied to fabrics using a dilute aqueous solution of a polycarboxylate polymer in the presence of a water-soluble salt of a polyvalent metal. The polyvalent metal salt serves to decrease the solubility of the polymer sufficiently to cause the polymer to be deposited onto the fabric from dilute aqueous solution. The ratio of metal salt to the copolymer ranges from 1:5 to 20:1.

Polycarboxylate polymers found to be effective soil-release agents when applied from dilute solution in the presence of a polyvalent metal salt are those polycarboxylate polymers having an acid equivalent weight (i.e., gram per mole of carboxylate) in the range of from about 100 to 175. The preferred acid equivalent weight for these polymers for use in this invention is about 110 to about 135.

The most effective polymers for use as soil-release agents applied from dilute solution in the presence of water-soluble polyvalent metal salts are copolymers of an ethylenically unsaturated monocarboxylic acid and a lower alkyl acrylate or methacrylate. The acid component may be acrylic, methacrylic, ethacrylic, crotonic or the like. The acrylate may be a $C_{1-8}$ alkyl acrylate or methacrylate, such as, methyl, ethyl, propyl, etc. Preferred are the copolymers of acrylic or methacrylic acid with $C_{2-4}$ acrylates, most preferred are the methacrylic acid/ethyl acrylate copolymers. The relative weight ratios of two monomeric components can vary from about 50% acid to about 50% acrylate to about 75% acid to about 25% acrylate, a ratio of about 60 to 70% acid to about 40 to 30% acrylate is preferred, optimally about a ⅔:⅓ relative proportion.

The copolymers that are effective generally have molecular weights ranging from about two thousand to about 5 million, although copolymers having a molecular weight of about 500,000 to about 1 million are preferred. The copolymers form a hydrophilic film on the treated fibers upon drying, and afford soil releasability at that point. Each subsequent treatment with the polymer serves to enhance the soil-release characteristics of the substrate.

The polyvalent metal salts that can be used effectively include the water-soluble salts of calcium, magnesium, zirconium, tin, aluminum, zinc, and barium. Specific examples of these salts include ziroconium oxychloride, stannic chloride, aluminum sulfate, zinc chloride, zirconium, barium acetate. The polyvalent metal salts found to be particularly effective in the practice of this invention are the salts of calcium and magnesium, such as calcium chloride, calcium sulfate, calcium nitrate, calcium acetate, magnesium chloride, magnesium sulfate, magnesium nitrate, and magnesium acetate. The metal salts can be present in solutions of compositions in amounts ranging from about 0.001% to about 1.0%, although a range of from about 0.01% to about 0.20% is preferred.

The ratio of polyvalent metal salt to polycarboxylate polymer of the present invention ranges from about 1:5 to about 20:1 although a range of about 1:5 to about 4:1 is preferred.

The compositions can be effectively used in aqueous solution at between 0.01% to 1.0%, and are effective at pH ranges between about 4.5 and about 9.5. The compositions are thus particularly effective for use in the rinse cycle of the home laundry process, for imparting a temporary soil-release finish to fabrics as soon as the fabrics are washed.

The soil-release properties of pure cellulosic fiber fabrics are much better than those of synthetic fiber-containing fabrics, e.g., polyester fibers, in that the synthetic polyester fibers are hydrophobic and thus prevent the ingress of water that is necessary for cleaning the fabric, and also possess an electrical charge that attracts soil particles. The present invention is therefore most primarily directed to fabrics containing a substantial portion of synthetic fibers, most notably polyester fiber.

The present composition may be used to treat a wide variety of texile materials made exclusively from synthetic polymer fibers, as well as blends of natural and synthetic fibers. Examples of synthetic fibers which may be successfully employed in the practice of the present invention include those made with polyamide, acrylic, and polyester fibers. Blends of natural and synthetic fibers which may be successfully treated according to the present invention include fabrics comprising 50% polyester/50% cotton, 65% polyester/35% cotton, etc., though not limited to these weight percentages. Cellulose fibers, for example, cotton, viscose, regenerated cellulose, etc., also may be combined with the synthetic fibers.

DESCRIPTION OF THE PREFERRED EMBODIMENTS

EXAMPLE 1

Soil-release compositions were formulated using a copolymer of about ⅔ methacrylic acid and about ⅓ ethylacrylate, having a molecular weight of about 1 million, and the percentage of a divalent metal salt as shown in Table I.

Table I

| Composition | Salt and Concentration |
|---|---|
| A | 0.1 % $MgCl_2$ |
| B | 1 % $MgCl_2$ |
| C | 0.1 % $CaCl_2$ |
| D | 1 % $CaCl_2$ |
| E | 0.2 % Ba acetate |
| F | 0.14 % $ZnCl_2$ |

Aqueous treating solutions were made up using 0.05% by weight of the copolymer and the salt concentration listed; the pH of these compositions was about 5. Prewashed swatches of 65% polyester/35% cotton with a permanent press finish were soaked for 10 minutes in the treating solution and allowed to dry.

Three drops of 1:1 used motor oil/mineral oil were dropped into the center of each of the swatches, and the oil was allowed to spread and set for three hours. The swatches were then washed in a solution of 1.5 g/liter of a 10-2-2 (anionic-nonionic-soap) commercially available household laundry detergent for ten minutes at 80°–90° F., and rinsed for 5 minutes.

Table II shows the final reflectance value, in Rd units, of the swatches. The control received no soil-release treatment prior to being soiled with the oil mixture.

Table II

| Swatches | Reflectance, Rd units |
|---|---|
| A | 77.1 |

Table II-continued

| Swatches | Reflectance, Rd units |
|---|---|
| B | 78.6 |
| C | 76.4 |
| D | 60.7 |
| E | 55.6 |
| F | 58.7 |
| Control | 48.7 |

EXAMPLE II

Soil-release compositions were formulated using the copolymer of Example I and the following concentrations of the following salts.

Table III

| Swatch | Salt and Concentration | | pH of Treating Solution |
|---|---|---|---|
| A | 0.1 | % $CaCl_2$ | 4.8 |
| B | 0.04 | % $CaCl_2$ | 4.9 |
| C | 0.1 | % $CaCl_2$ | 6.8 |
| D | 0.04 | % $CaCl_2$ | 6.9 |
| E | 0.1 | % $MgCl_2$ | 4.9 |
| F | 0.04 | % $MgCl_2$ | 5.1 |
| G | 0.1 | % $MgCl_2$ | 7.0 |
| H | 0.04 | % $MgCl_2$ | 6.9 |

Treating solutions were made up using 0.05% by weight of the copolymer and the salt concentration listed; the pH of each solution is shown in Table III. Identical prewashed swatches of 65% polyester/35% cotton with a permanent press finish were soaked for 10 minutes in the treating solution and dried in a dryer.

Three drops of 1:1 used motor oil/mineral oil were dropped into the center of each of the swatches, and the oil was allowed to spread and set for three hours. The swatches were then washed in a solution of 1.5 g/liter of a 10-2-2 (anionic-nonionic-soap) commercially available household laundry detergent for ten minutes at 80°–90° F., and rinsed for 5 minutes.

Table IV shows the final reflectance value, in Rd units, of the swatches. The control received no soil-release treatment prior to being soiled with the oil mixture.

Table IV

| Swatches | Reflectance, Rd Units |
|---|---|
| A | 72.3 |
| B | 64.8 |
| C | 71.5 |
| D | 71.2 |
| E | 71.2 |
| F | 69.8 |
| G | 74.1 |
| H | 72.0 |
| Control | 48.7 |

EXAMPLES III – VIII

The procedure of example I is repeated in like fashion except that instead of the copolymer employed therein, the following copolymers are substituted for compositions A–F, respectively.

A′ — methacrylic acid - propyl acrylate
B′ — methacrylic acid - butyl acrylate
C′ — acrylic acid - methyl methacrylate
D′ — acrylic acid - propyl methacrylate
E′ — acrylic acid - butyl methacrylate
F′ — crotonic acid - ethyl acrylate
A″ — fumaric acid - propyl acrylate The same good results obtain.

EXAMPLES IX – XVI

The procedure of example II is repeated except that the respective amounts of monomer employed is varied as follows:

A‴ 50% acid to 50% acrylate
B″ 50% acid to 50% acrylate
C″ 75% acid to 25% acrylate
D″ 75% acid to 25% acrylate
E″ 50% acid to 50% acrylate
F″ 75% acid to 25% acrylate
G″ 60% acid to 70% acrylate
H″ 70% acid to 30% acrylate The same good results obtain.

The foregoing examples illustrte the effectiveness of the composition comprising the disclosed copolymers and a metal salt as a soil-release agent when deposited from dilute solution.

The compositions of the present invention are particularly well adapted for use in the rinse cycle of a home laundry system; the compositions can be added directly to the rinse water without adjusting the pH or the temperature of the water.

None of the swatches treated in the foregoing examples had chunks of polymer visible on the surface of the swatches, and the original hand of the fabrics was not adversely affected by the treatment with the soil-release polymer of the present invention.

What is claimed is:

1. A composition for imparting non-permanent soil-release characteristics to textile fabrics comprising a copolymer of an ethylenically unsaturated monocarboxylic monomer and a lower alkyl acrylate or methacrylate, said polymer having an acid equivalent weight of from about 110 to 175 and a water-soluble salt of a polyvalent metal, said salt being selected from the group consisting of water-soluble salts of magnesium, calcium, zirconium, tin, aluminum, zinc and barium.

2. The composition of claim 1 wherein the water-soluble salt is a magnesium salt.

3. The composition of claim 1 wherein the water-soluble salt is a calcium salt.

4. The composition of claim 1 wherein said acid is selected from the group consisting of acrylic, methacrylic, ethacrylic and crotonic.

5. The composition of claim 1 wherein said acid is methacrylic acid.

6. The composition of claim 1 wherein said acrylate is ethyl acrylate.

7. The composition of claim 1 wherein said acid is employed in amounts of about 60 to 70% and said acrylate in amounts of 40 to 30% by weight.

8. The composition of claim 1 wherein said polymer has an acid equivalent of about 110 to 125.

9. The composition of claim 1 wherein said polymer has a molecular weight of about 2,000 to about 2,000,000.

10. The composition of claim 1 wherein the ratio of said polyvalent metal salt to said copolymer is from 1:5 to 20:1.

11. The composition of claim 1 wherein the polymer has a molecular weight of about 1 million.

12. A dilute aqueous solution of the composition as defined in claim 1 containing about 0.01 to about 1.0% by weight of said composition.

13. A solution as defined in claim 12 having a pH in the range of about 4.5 to about 9.5.

14. A solution as defined in claim 13 containing about 0.001 to about 1.0% of said salt.

15. A soil resistant synthetic fiber-containing material having an effective amount of the composition as defined in claim 1.

16. A material as defined in claim 15 wherein said fiber is selected from the group consisting of polyester, polyamide, acrylic, cellulose, cotton-synthetic blends regenerated cellulose and blends thereof.

17. A method of rendering synthetic fiber-containing materials soil resistant comprising applying thereto an effective amount of a solution as defined in claim 12.

18. A composition as defined in claim 12 wherein the ratio of said acid to said acrylate or methacrylate is about two thirds acid to about one third acrylate or methacrylate.

19. The composition of claim 1 wherein the relative ratios of the two monomers is about 50:50 to 75:25.

* * * * *